US010319271B2

(12) United States Patent
Dunn et al.

(10) Patent No.: US 10,319,271 B2
(45) Date of Patent: Jun. 11, 2019

(54) CYCLIC REDUNDANCY CHECK FOR ELECTRONIC DISPLAYS

(71) Applicant: Manufacturing Resources International, Inc., Alpharetta, GA (US)

(72) Inventors: William Dunn, Alpharetta, GA (US); Scott Hamilton, Coleshill (GB); David Williams, Canton, GA (US); Gerald Fraschilla, Snellville, GA (US)

(73) Assignee: MANUFACTURING RESOURCES INTERNATIONAL, INC., Alpharetta, GA (US)

( * ) Notice: Subject to any disclaimer, the term of this patent is extended or adjusted under 35 U.S.C. 154(b) by 0 days.

(21) Appl. No.: 15/077,416

(22) Filed: Mar. 22, 2016

(65) Prior Publication Data

US 2017/0278440 A1 Sep. 28, 2017

(51) Int. Cl.
*G09G 3/20* (2006.01)

(52) U.S. Cl.
CPC ..... *G09G 3/20* (2013.01); *G09G 2320/046* (2013.01); *G09G 2360/16* (2013.01)

(58) Field of Classification Search
CPC ..... G06T 3/0093; G06T 15/005
USPC ..... 345/644
See application file for complete search history.

(56) References Cited

U.S. PATENT DOCUMENTS 4,271,410 A 6/1981 Crawford
4,399,456 A 8/1983 Zalm
4,456,910 A 6/1984 DiMassimo et al.
4,571,616 A 2/1986 Haisma et al.
4,593,978 A 6/1986 Mourey et al.
4,753,519 A 6/1988 Miyatake
5,029,982 A 7/1991 Nash
5,049,987 A 9/1991 Hoppenstein
5,081,523 A 1/1992 Frazier
(Continued)

FOREIGN PATENT DOCUMENTS

CN 1613264 A 5/2005
CN 101777315 7/2010
(Continued)

OTHER PUBLICATIONS

AMS AG, TC53404, TCS3414, Digital Color Sensors, Apr. 2011, 41 pages, Texas Advanced Optoelectronic Solutions Inc. is now ams AG.

(Continued)

*Primary Examiner* — Jin Ge
(74) *Attorney, Agent, or Firm* — Standley Law Group LLP; Jeffrey S. Standley; Eric M. Gayan

(57) ABSTRACT

A system and method for preventing image retention in an electronic display. A time threshold (TT) and a pixel threshold (PT) may be defined. The system preferably performs a checksum calculation of all pixel data within an active image area of the electronic display for an interval of time until reaching TT. The system may then compare the checksum calculation for each interval of time to determine if the change in pixel data is less than PT. Preferably, the system will perform an image retention prevention method for the active image area if the change in pixel data is less than PT. Generally, this is performed by transmitting alternate pixel data to the electronic display.

18 Claims, 5 Drawing Sheets

(56) References Cited

U.S. PATENT DOCUMENTS 5,088,806 A 2/1992 McCartney et al.
5,115,229 A 5/1992 Shalit
5,162,645 A 11/1992 Wagensonner et al.
5,162,785 A 11/1992 Fagard
5,351,201 A 9/1994 Harshbarger, Jr. et al.
5,402,141 A 3/1995 Haim
5,565,894 A 10/1996 Bates et al.
5,656,824 A 8/1997 Kaplit
5,663,952 A 9/1997 Gentry, Jr.
5,694,141 A 12/1997 Chee
5,751,346 A 5/1998 Dozier et al.
5,835,074 A 11/1998 Didier et al.
5,886,731 A 3/1999 Ebisawa
6,027,222 A 2/2000 Oki et al.
6,032,126 A 2/2000 Kaehler
6,055,012 A 4/2000 Haskell et al.
6,075,556 A 6/2000 Urano et al.
6,091,777 A 7/2000 Guetz et al.
6,094,457 A 7/2000 Linzer et al.
6,100,906 A 8/2000 Asaro et al.
6,153,985 A 11/2000 Grossman
6,192,083 B1 2/2001 Linzer et al.
6,259,492 B1 7/2001 Imoto et al.
6,292,157 B1 9/2001 Greene et al.
6,292,228 B1 9/2001 Cho
6,297,859 B1 10/2001 George
6,326,934 B1 12/2001 Kinzie
6,359,390 B1 3/2002 Nagai
6,392,727 B1 5/2002 Larson et al.
6,417,900 B1 7/2002 Shin et al.
6,421,103 B2 7/2002 Yamaguchi
6,421,694 B1 7/2002 Nawaz et al.
6,428,198 B1 8/2002 Saccomanno et al.
6,536,041 B1 3/2003 Knudson et al.
6,546,294 B1 4/2003 Kelsey et al.
6,553,336 B1 4/2003 Johnson et al.
6,587,525 B2 7/2003 Jeong et al.
6,642,666 B1 11/2003 St-Germain
6,674,463 B1 1/2004 Just et al.
6,690,726 B1 2/2004 Yavits et al.
6,697,100 B2 2/2004 Tatsuzawa
6,698,020 B1 2/2004 Zigmond et al.
6,712,046 B2 3/2004 Nakamichi
6,812,851 B1 11/2004 Dukach et al.
6,820,050 B2 11/2004 Simmon et al.
6,825,899 B2 11/2004 Kobayashi
6,850,209 B2 2/2005 Mankins et al.
6,996,460 B1 2/2006 Krahnstoever et al.
7,038,186 B2 5/2006 De Brabander et al.
7,057,590 B2 6/2006 Lim et al.
7,103,852 B2 9/2006 Kairis, Jr.
7,136,415 B2 11/2006 Yun et al.
7,174,029 B2 2/2007 Agostinelli et al.
7,304,638 B2 12/2007 Murphy
7,307,614 B2 12/2007 Vinn
7,319,862 B1 1/2008 Lincoln et al.
7,358,851 B2 4/2008 Patenaude et al.
7,385,593 B2 6/2008 Krajewski et al.
7,391,811 B2 6/2008 Itoi et al.
7,480,042 B1 1/2009 Phillips
7,518,600 B2 4/2009 Lee
7,573,458 B2 8/2009 Dunn
7,581,094 B1 8/2009 Apostolopoulos et al.
7,614,065 B2 11/2009 Weissmueller et al.
7,636,927 B2 12/2009 Zigmond et al.
7,669,757 B1 3/2010 Crews et al.
7,714,834 B2 5/2010 Dunn
7,764,280 B2 7/2010 Shiina
7,810,114 B2 7/2010 Flickinger et al.
7,813,694 B2 10/2010 Fishman et al.
7,825,991 B2 11/2010 Enomoto
7,924,263 B2 4/2011 Dunn
7,937,724 B2 5/2011 Clark et al.
7,988,849 B2 8/2011 Biewer et al.
8,130,836 B2 3/2012 Ha
8,212,921 B2 7/2012 Yun
8,218,812 B2 7/2012 Sugimoto et al.
8,242,974 B2 8/2012 Yamazaki et al.
8,350,799 B2 1/2013 Wasinger et al.
8,400,570 B2 3/2013 Dunn et al.
8,417,376 B1 4/2013 Smolen
8,441,574 B2 5/2013 Dunn et al.
8,605,121 B2 12/2013 Chu et al.
8,689,343 B2 4/2014 De Laet
8,704,752 B2 4/2014 Wasinger et al.
8,823,630 B2 9/2014 Roberts et al.
9,026,686 B2 5/2015 Dunn et al.
9,031,872 B1 5/2015 Foster
2001/0019454 A1 9/2001 Tadic-Galeb et al.
2002/0018522 A1 2/2002 Wiedenmann
2002/0026354 A1 2/2002 Shoji et al.
2002/0112026 A1 8/2002 Fridman et al.
2002/0120721 A1 8/2002 Eilers et al.
2002/0147648 A1 10/2002 Fadden et al.
2002/0154138 A1 10/2002 Wada et al.
2002/0163513 A1 11/2002 Tsuji
2002/0164962 A1 11/2002 Mankins et al.
2002/0190972 A1 12/2002 Ven de Van
2002/0194365 A1 12/2002 Jammes
2002/0194609 A1 12/2002 Tran
2003/0031128 A1 2/2003 Kim et al.
2003/0039312 A1 2/2003 Horowitz et al.
2003/0061316 A1 3/2003 Blair et al.
2003/0098881 A1 5/2003 Nolte et al.
2003/0117428 A1 6/2003 Li et al.
2003/0125892 A1 7/2003 Edge
2003/0161354 A1 8/2003 Bader et al.
2003/0177269 A1 9/2003 Robinson et al.
2003/0196208 A1 10/2003 Jacobson
2003/0202605 A1 10/2003 Hazra et al.
2003/0227428 A1 12/2003 Nose
2004/0012722 A1 1/2004 Alvarez
2004/0114041 A1 6/2004 Doyle et al.
2004/0138840 A1 7/2004 Wolfe
2004/0194131 A1 9/2004 Ellis et al.
2004/0207738 A1 10/2004 Wacker
2004/0252187 A1 12/2004 Alden
2005/0005302 A1 1/2005 Zigmond et al.
2005/0012734 A1* 1/2005 Johnson ..... G09G 3/3648 345/211
2005/0046951 A1 3/2005 Sugihara et al.
2005/0071252 A1 3/2005 Henning et al.
2005/0123001 A1 6/2005 Craven et al.
2005/0127796 A1 6/2005 Olesen et al.
2005/0134525 A1 6/2005 Tanghe et al.
2005/0134526 A1 6/2005 Willem et al.
2005/0184983 A1 8/2005 Brabander et al.
2005/0188402 A1 8/2005 de Andrade et al.
2005/0195330 A1 9/2005 Zacks et al.
2005/0216939 A1 9/2005 Corbin
2005/0253699 A1 11/2005 Madonia
2005/0289061 A1 12/2005 Kulakowski et al.
2005/0289588 A1 12/2005 Kinnear
2006/0087521 A1 4/2006 Chu et al.
2006/0150222 A1 7/2006 McCafferty et al.
2006/0160614 A1 7/2006 Walker et al.
2006/0214904 A1 9/2006 Kimura et al.
2006/0215044 A1 9/2006 Masuda et al.
2006/0244702 A1 11/2006 Yamazaki et al.
2007/0047808 A1 3/2007 Choe et al.
2007/0094620 A1 4/2007 Park
2007/0120763 A1 5/2007 De Paepe et al.
2007/0127569 A1* 6/2007 Hatalkar ..... G06F 3/14 375/240.12
2007/0152949 A1 7/2007 Sakai
2007/0157260 A1 7/2007 Walker
2007/0164932 A1* 7/2007 Moon ..... G09G 3/288 345/63
2007/0165955 A1 7/2007 Hwang et al.
2007/0168539 A1 7/2007 Day
2007/0200513 A1 8/2007 Ha et al.
2007/0211179 A1 9/2007 Hector et al.
2007/0247594 A1 10/2007 Tanaka
2007/0274400 A1 11/2007 Murai et al.

(56) References Cited

U.S. PATENT DOCUMENTS

2007/0286107 A1 12/2007 Singh et al.
2008/0008471 A1 1/2008 Dress
2008/0017422 A1 1/2008 Carro
2008/0018584 A1 1/2008 Park et al.
2008/0028059 A1 1/2008 Shin et al.
2008/0037783 A1 2/2008 Kim et al.
2008/0055247 A1 3/2008 Boillot
2008/0074372 A1 3/2008 Baba et al.
2008/0093443 A1 4/2008 Barcelou
2008/0104631 A1 5/2008 Krock et al.
2008/0106527 A1 5/2008 Cornish et al.
2008/0112601 A1 5/2008 Warp
2008/0119237 A1 5/2008 Kim
2008/0143637 A1 6/2008 Sunahara et al.
2008/0163291 A1 7/2008 Fishman et al.
2008/0170028 A1 7/2008 Yoshida
2008/0174522 A1* 7/2008 Cho ..... G09G 3/2927 345/60
2008/0201208 A1 8/2008 Tie et al.
2008/0231604 A1 9/2008 Peterson
2008/0232478 A1 9/2008 Teng et al.
2008/0246871 A1 10/2008 Kupper et al.
2008/0266331 A1 10/2008 Chen et al.
2008/0272999 A1 11/2008 Kurokawa et al.
2008/0278432 A1 11/2008 Ohshima
2008/0278455 A1 11/2008 Atkins et al.
2008/0303918 A1 12/2008 Keithley
2008/0313046 A1 12/2008 Denenburg et al.
2009/0036190 A1 2/2009 Brosnan et al.
2009/0058845 A1 3/2009 Fukuda et al.
2009/0102914 A1 4/2009 Collar et al.
2009/0102973 A1 4/2009 Harris
2009/0109165 A1 4/2009 Park et al.
2009/0128867 A1 5/2009 Edge
2009/0164615 A1 6/2009 Akkanen
2009/0182917 A1 7/2009 Kim
2009/0219295 A1* 9/2009 Reijnaerts ..... G06F 3/1415 345/501
2009/0251602 A1 10/2009 Williams et al.
2009/0254439 A1 10/2009 Dunn
2009/0260028 A1 10/2009 Dunn et al.
2009/0267866 A1 10/2009 Reddy et al.
2009/0273568 A1 11/2009 Milner
2009/0289968 A1 11/2009 Yoshida
2009/0313125 A1 12/2009 Roh et al.
2009/0315867 A1 12/2009 Sakamoto et al.
2010/0039440 A1 2/2010 Tanaka et al.
2010/0039696 A1 2/2010 de Groot et al.
2010/0060550 A1 3/2010 McGinn et al.
2010/0083305 A1 4/2010 Acharya et al.
2010/0104003 A1 4/2010 Dunn et al.
2010/0109974 A1 5/2010 Dunn et al.
2010/0177157 A1 7/2010 Berlage
2010/0177158 A1 7/2010 Walter
2010/0188342 A1 7/2010 Dunn
2010/0194861 A1 8/2010 Hoppenstein
2010/0195865 A1 8/2010 Luff
2010/0198983 A1 8/2010 Monroe et al.
2010/0231563 A1 9/2010 Dunn et al.
2010/0238299 A1 9/2010 Dunn et al.
2010/0242081 A1 9/2010 Dunn et al.
2010/0253613 A1 10/2010 Dunn et al.
2010/0253778 A1 10/2010 Lee et al.
2011/0012856 A1 1/2011 Maxwell et al.
2011/0047567 A1 2/2011 Zigmond et al.
2011/0069018 A1 3/2011 Atkins et al.
2011/0074803 A1 3/2011 Kerofsky
2011/0078536 A1* 3/2011 Han ..... G06F 3/1462 714/758
2011/0102630 A1 5/2011 Rukes
2011/0181693 A1 7/2011 Lee et al.
2011/0225859 A1 9/2011 Safavi
2011/0273482 A1* 11/2011 Massart ..... G09G 3/20 345/690
2012/0075362 A1 3/2012 Ichioka et al.
2012/0182278 A1 7/2012 Ballestad
2012/0188262 A1* 7/2012 Rabii ..... G09G 5/393 345/534
2012/0203872 A1 8/2012 Luby et al.
2012/0268350 A1 10/2012 Yoshimura
2012/0302343 A1 11/2012 Hurst et al.
2013/0110565 A1 5/2013 Means, Jr. et al.
2013/0162908 A1 6/2013 Son et al.
2014/0043302 A1 2/2014 Barnes
2014/0139116 A1 5/2014 Reed
2014/0333541 A1 11/2014 Lee et al.
2014/0375704 A1* 12/2014 Bi ..... G09G 3/3275 345/694
2015/0070340 A1 3/2015 Trachtenberg et al.
2015/0312488 A1* 10/2015 Kostrzewa ..... H04N 5/2253 348/164
2016/0014103 A1 1/2016 Masters et al.
2016/0034240 A1 2/2016 Kreiner et al.
2016/0063954 A1* 3/2016 Ryu ..... G06F 3/04847 345/589
2016/0125777 A1* 5/2016 Knepper ..... G09G 3/007 345/611
2016/0293206 A1 10/2016 Dunn
2016/0335705 A1 11/2016 Williams et al.
2016/0358357 A1 12/2016 Dunn et al.
2017/0111486 A1 4/2017 Bowers et al.

FOREIGN PATENT DOCUMENTS

CN 102246196 A 11/2011
EP 0313331 A2 4/1989
EP 1640337 A2 3/2006
EP 2332120 A2 6/2011
EP 2401736 A2 1/2012
EP 2401869 A2 1/2012
ID 0514488 A 9/2011
JP 2002064842 A 2/2002
JP 2002209230 A 7/2002
JP 2002366121 A 12/2002
JP 2005236469 A 9/2005
JP 2006184859 A 7/2006
JP 2008034841 A 2/2008
JP 2008165055 A 7/2008
JP 2009009422 A 1/2009
KR 20000021499 A 4/2000
KR 20020072633 A 9/2002
TW 200403940 A 3/2004
WO WO9608892 A1 3/1996
WO WO2006089556 A1 8/2006
WO WO2006111689 A1 10/2006
WO WO2009004574 A1 1/2009
WO WO2010037104 A2 4/2010
WO WO2010085783 A1 7/2010
WO WO2010085784 A2 7/2010
WO WO2010094039 A2 8/2010
WO WO2010099178 A2 9/2010
WO WO2010099194 A2 9/2010
WO WO2011026186 A1 3/2011
WO WO2011035370 A1 3/2011
WO WO2011044640 A1 4/2011
WO WO2011060487 A1 5/2011
WO WO2011143720 A1 11/2011
WO WO2016000546 A1 1/2016

OTHER PUBLICATIONS

Analog Devices, ADV212: JPEG 2000 Video Codec, http://www.analog.com/en/audiovideo-products/video-compression/ADV212/products/pr . . . , accessed Oct. 15, 2008, 2 pages.
Analog Devices, Inc., JPEG 2000 Video Codec ADV212, 2006, 44 pages.
Photo Research, Inc., PR-650 SpectraScan Colorimeter, 1999, 2 pages.
Teravision Corp, LCD-TV Panel Control Board Specification, Nov. 2007, 24 pages.
Texas Advanced Optoelectronic Solutions Inc., TCS230 Programmable Color Light-To-Frequency converter, Dec. 2007, 12 pages.

(56) References Cited

OTHER PUBLICATIONS

Texas Advanced Optoelectronic Solutions Inc., TCS3404CS, TCS3414CS Digital Color Light Sensors, Feb. 2009, 38 pages.
Wikipedia, Color rendering index, https://en.wikipedia.org/wiki/Color_rendering_index, accessed Aug. 25, 2016, 13 pages.
Wikipedia, Gamut, https://en.wikipedia.org/wiki/Gamut, accessed Aug. 25, 2016, 8 pages.
Wikipedia, Gradient-index optics, https://en.wikipedia.org/wiki/Gradient-index_optics, accessed Aug. 25, 2016, 5 pages.

* cited by examiner

| Location | t=1 | t=2 | t=3 | t=4 |
|---|---|---|---|---|
| 1 | 156.23 | 56.32 | 70.36 | 45.55 |
| 2 | 45.65 | 126.35 | 110.33 | 45.55 |
| 3 | 78.56 | 78.56 | 78.56 | 78.56 |
| 4 | 110.25 | 110.35 | 110.25 | 110.35 |
| 5 | 65.62 | 45.45 | 45.45 | 68.56 |

Time Threshold (TT)

Total Number of Locations (N)

CYCLIC REDUNDANCY CHECK FOR ELECTRONIC DISPLAYS

CROSS-REFERENCE TO RELATED APPLICATIONS

This application does not claim priority to any pending applications.

TECHNICAL FIELD

Embodiments generally relate to electronic displays used for advertising, informational, and point of sale applications.

BACKGROUND OF THE ART

Electronic displays are now used in a variety of applications where the displays remain on for extended periods of time. In some applications, the displays may show a single static image for hours at a time. In other applications, portions of the display might be showing dynamic video while other portions show a static image. In other applications, a display might malfunction and 'freeze' and show a single image until the malfunction has been corrected. It has been found that leaving a static image on an electronic display for a long period of time can cause burn-in or image retention, where distinct marks or patterns can be seen on the display at all times, due to previous long-held static image signals.

SUMMARY OF THE EXEMPLARY EMBODIMENTS

Exemplary embodiments provide a system and method for determining when image retention could be a concern for an electronic display. The exemplary systems and methods can determine when portions of the display might be at risk, even while others are clearly not. An Image Retention Prevention Method is preferably ran when portions of a display (or the entire display) have been determined to have image retention concerns. The overall appearance of the display should not be affected when the Image Retention Prevention Method is performed. In other words, to a viewer, there should be no discernable difference in the viewed image whether the Image Retention Prevention Method is being ran or not.

The foregoing and other features and advantages of the present invention will be apparent from the following more detailed description of the particular embodiments, as illustrated in the accompanying drawings.

BRIEF DESCRIPTION OF THE DRAWINGS

A better understanding of an exemplary embodiment will be obtained from a reading of the following detailed description and the accompanying drawings wherein identical reference characters refer to identical parts and in which.

DETAILED DESCRIPTION

Figure 1:
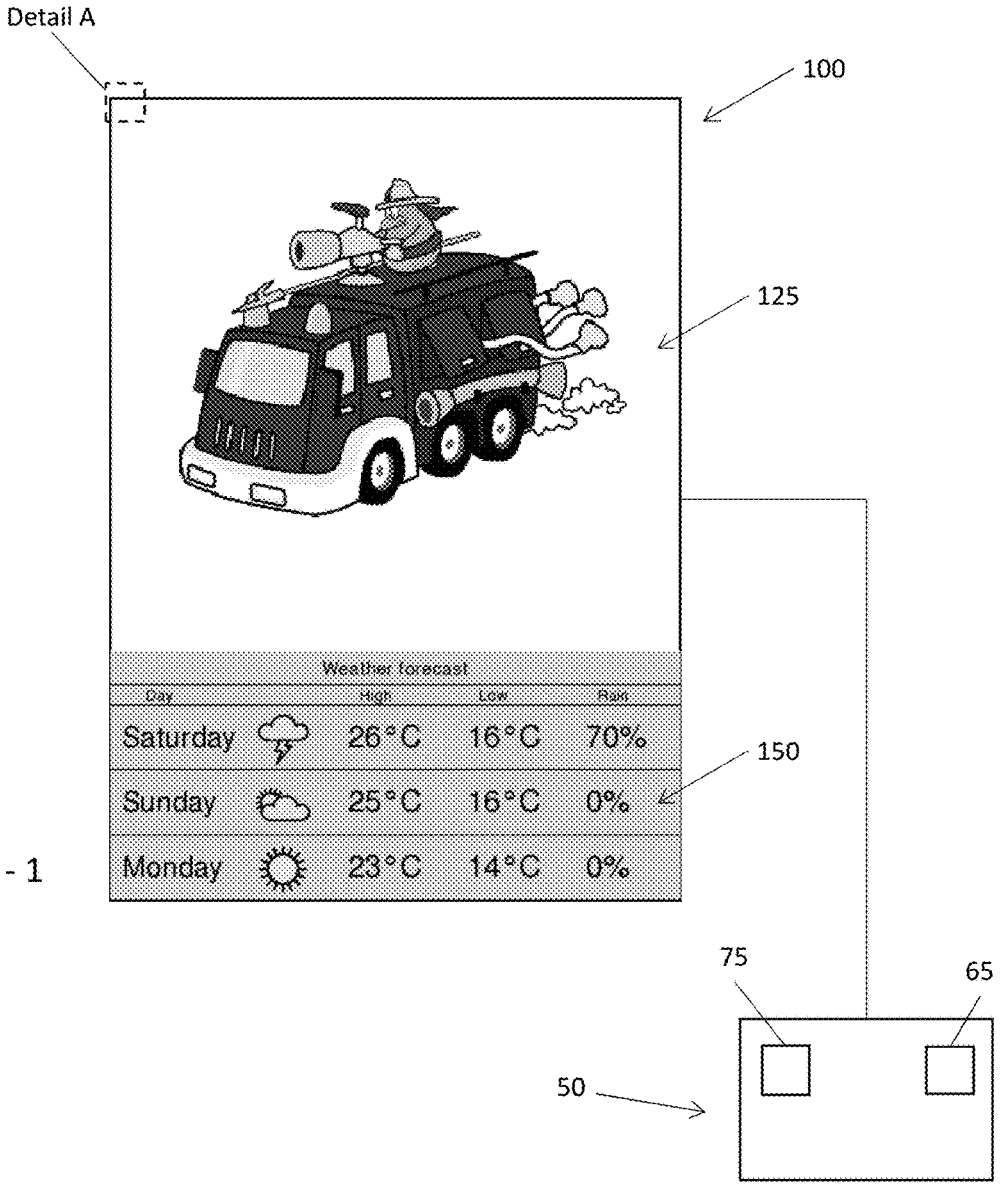
FIG. 1 is a front elevation view of an exemplary electronic display having both dynamic and static images being shown simultaneously, and indicating the location for Detail A.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a front elevation view of an exemplary electronic display 100 having both dynamic and static images being shown simultaneously, and indicating the location for Detail A. A display controller 50 is in electrical connection with the display 100 and includes several components, specifically a processor 75 and electronic storage 65. As is well known in the art, a display controller 50 can include many different components, which will not be examined in detail here. Generally speaking, a display controller 50 may also be considered a video player, as it may accept the image/video content data for optional modification/analysis (as described herein) and eventual transmission to the display 100. Thus, connections such as incoming power and video signal have not been shown, but would be understood to be present by a person of ordinary skill in the art.

As shown in this figure, the display controller 50 is currently sending pixel data for a dynamic video on a first portion 125 of the electronic display's active image area while simultaneously sending pixel data for a static image on a second portion 150 of the electronic display's active image area. It should be immediately noted, that although a portrait display is shown here, this is not required as any orientation will work with the disclosed embodiments. Further, embodiments are not limited to only two areas (i.e. one dynamic video and one static image) as any number of areas could be combined and there could be multiple static image areas as well as multiple dynamic video areas.

As will be described further below, the exemplary method analyzes the data for pixels of the electronic display, and these pixels can be sub-pixels (a single color) or the combined color pixel (multiple sub-pixels combined to produce a color). There is no requirement for any embodiments that a specific type of pixel is used for the analysis. Further, there is no requirement that a specific type of electronic display is used either, as any display which produces an image based on a combination of pixels will suffice. Thus, the electronic display 100 could be any one of the following: LCD, LED, plasma, OLED, and any form of electroluminescent polymer.

Generally speaking, when presented with the situation shown in FIG. 1, the first portion 125 of the display is generally not susceptible to image retention, since the pixels are changing on a regular basis. However, the second portion 150 of the display is likely susceptible to image retention, since the pixels maintain the same light output (which generally translates to potential difference or voltage applied to each subpixel) for a long period of time. The exemplary method and system herein can detect pixels which have not changed substantially within a chosen Time Threshold (TT), and perform an Image Retention Prevention Method to combat possible image retention.

Figures 2, 3:
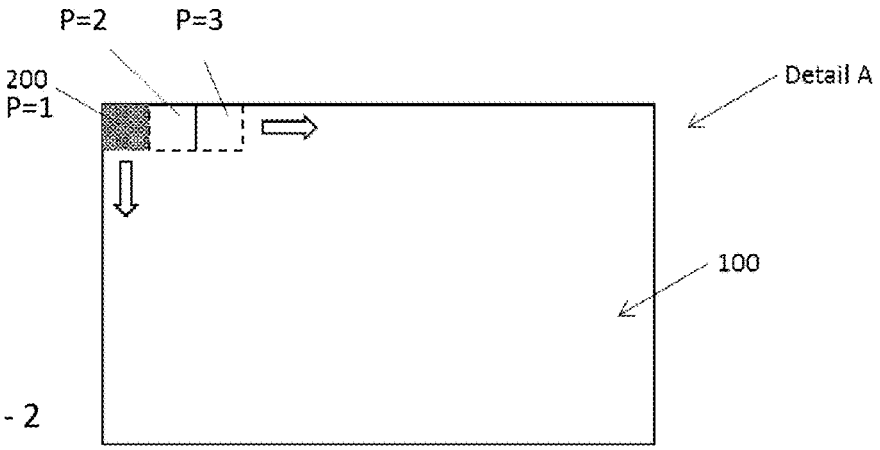
FIG. 2 is a detailed view of Detail A from FIG. 1, indicating an exemplary embodiment for the Analysis Area as it travels through each Location(L) on the electronic display.
FIG. 3 is a sample chart of exemplary check sum data for each Location(L) at each Time Interval(t).

FIG. 2 is a detailed view of Detail A from FIG. 1, indicating an exemplary embodiment for the Analysis Area (AA) 200 as it travels through each Location(L) on the electronic display 100. The Analysis Area is generally a selection of pixels that will be analyzed together. While it is shown here as a block, rectangle, or otherwise four-sided polygon, any shape will work with the exemplary embodiments. The Analysis Area could be a small fraction of the total active display area of the electronic display, and while no fraction is necessary, it has been found that anything between 0.001% and 1% of the total active display area would produce an acceptable Analysis Area. In some embodiments, the AA can be as large as 5% of the total active display area. For an exemplary embodiment on a 3840×2160 UHD display, it has been found that an AA of a 64 pixel×64 pixel block works very well, but this is not required.

Generally speaking, the Analysis Area 200 begins at Location 1, performs a check sum calculation of the pixel data for each pixel within the Analysis Area 200 when located at Location 1, and then moves on to Location 2, and so on until the Total Number of Locations (N) has been calculated. While shown in FIG. 2 as beginning in the upper left hand corner of the display, moving horizontally across the top edge of the display, and then moving down to the next row, until reaching the bottom right corner of the display, this is not required. Any path for the Analysis Area will work for the disclosed embodiments as there is no particular path that is required. One could of course begin at any location, and travel across the display in any path that works for the particular embodiment.

FIG. 3 is a sample chart of exemplary check sum data for each Location(L) at each Time Interval(t). It should be noted that this is a small and simplified chart and does not necessarily correspond with the situation shown in FIG. 1. The check sum data can be calculated in a number of ways but would preferably be a sum of the bits of data sent to each pixel within the AA at each Location(L). Alternatively, it could be any other digital value applied to each pixel, or alternatively the actual voltages or power sent to each pixel. The values provided are simply to illustrate an embodiment of the invention, and do not have any particular form or units for each value. An exemplary embodiment functions more on the difference between the checksum totals, and not so much on what the underlying values are for calculating the checksum totals.

The Time Threshold (TT) may be referred to as the total amount of time that the checksum data is calculated, before the system begins to analyze said checksum data. This value can be selected based on a number of seconds, minutes, frames of video, or a cycle time based on how long it takes a processor to calculated each Location(L) across the entire display one time (i.e. TT=60 cycles, where the system calculates the check sum data for each location 60 times before analyzing the data). Referring again to an embodiment on a 3840×2160 UHD display, it has been found that the checksum data can be calculated for each Location(L) every 69 seconds (at a 30 Hz refresh rate). Here, the TT may be selected as X cycles, which could also be referred to as (X*69) seconds, i.e. 10 cycles could also be referred to as 690 seconds.

The resulting check sum data shown in FIG. 3 can be analyzed in a number of ways. Generally, a Pixel Delta (PΔ) may be calculated for the selection of check sum data which generally measures the amount of change that the pixels have gone through during the Time Threshold (TT). This amount of change in the pixel data across the TT can then be compared to a Pixel Threshold (PT), which can be used to identify the minimum amount of change in the pixel data across the TT before image retention becomes a concern. In short, when the system recognizes that a group of pixels has not seen a change in pixel data that exceeds the PT, image retention becomes a concern, and the Image Retention Prevention Method may be performed.

The Pixel Delta (PΔ) can be measured as the amount of variance across the check sum data. In some embodiments, this is calculated as the standard deviation of the check sum data. With this type of embodiment, the Pixel Threshold (PT) can be selected as the minimum level of standard deviation that is acceptable before image retention becomes a concern. This can vary widely depending on the system being used. For example, some systems may be so accurate that PT can be extremely small, or even near zero, so that image retention is not a concern unless the pixel data remains almost constant throughout the entire TT. In other systems, there may be noise in the system that would necessitate placing the PT at a higher level, such that pixel data would not have to be constant to trigger the concern over image retention, only that the amount of change was lower than a pre-selected amount (which can be well above zero).

For example, assume that PΔ is calculated as the standard deviation and PT is very low, for this example PT=0. When analyzing the data from FIG. 3, it is clear that Locations 1, 2, and 5 would not be low enough to be equal to or less than PT (PΔ(1)=50.44, PΔ(2)=42.50, and PΔ(5)=12.55). While Location 4 is very close, it is also not equal to or less than PT (PΔ(4)=0.06). However, Location 3 does appear to have a PΔ equal to or less than PT (PΔ(3)=0. Thus it can be observed, that setting PT very low or near zero will only catch groups of pixels that have seen almost no change whatsoever during the TT. One of skill in the art could therefore see that PT could be increased to a value higher than zero (if desired) to ensure that the system catches other groups of pixels which perhaps have changed slightly over the TT, but not enough to remove concerns about image retention. The user may select the appropriate PT for their particular application.

Figure 4:
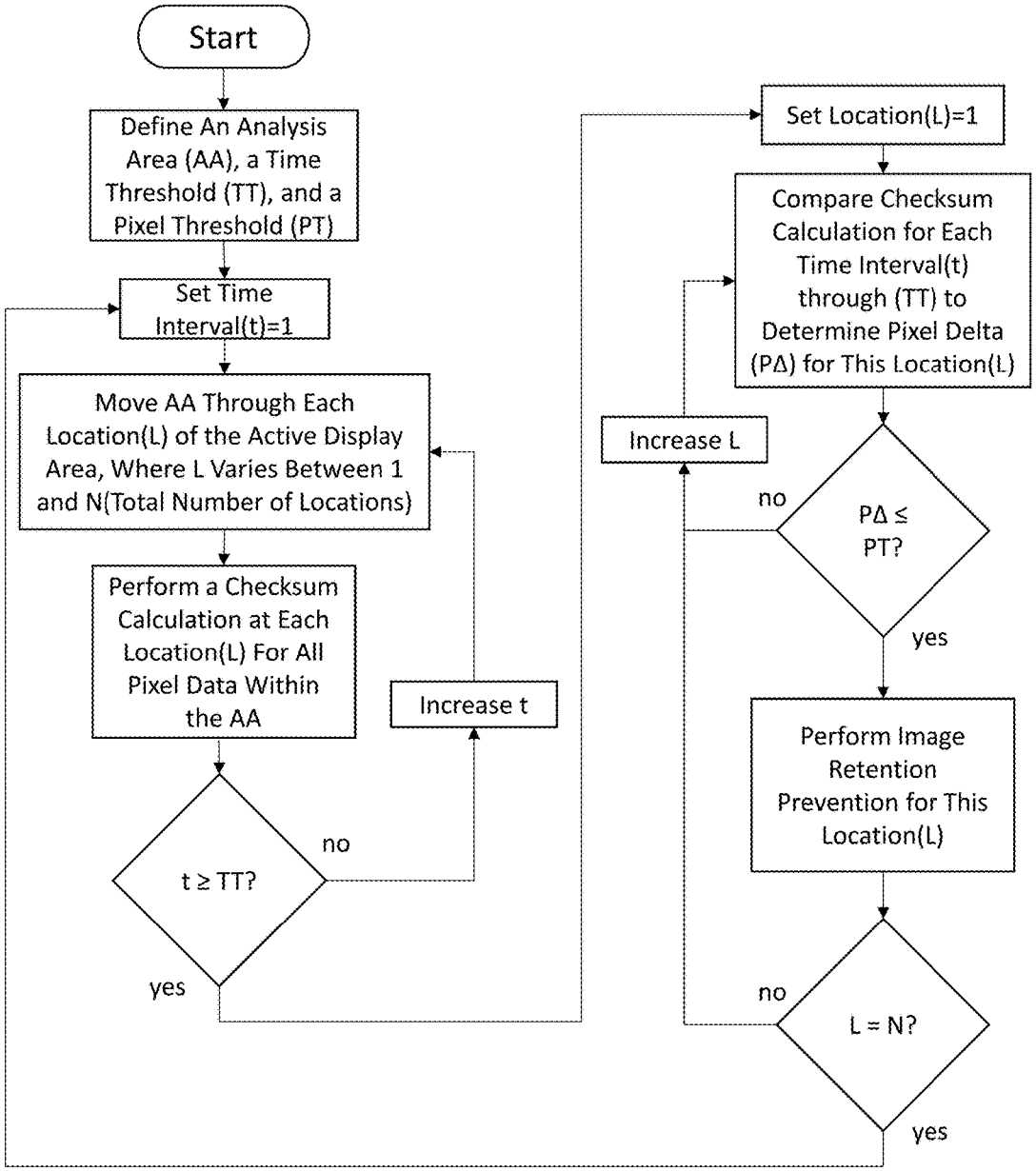
FIG. 4 is a logical flow chart for operating an exemplary form of the method.

FIG. 4 is a logical flow chart for operating an exemplary form of the method. During the initial setup, the Analysis Area (AA), Time Threshold (TT), and Pixel Threshold (PT) should be defined. Next, the Time Interval should be reset, and while it is suggested to set t=1, embodiments could set t=0 as well. The system would then move the AA through each Location(L) of the active display area and perform the checksum calculation for all pixel data within the AA at each Location (L). If Time Interval(t) has reach TT, the system begins the analysis phase, if not, t is increased and this process is repeated again for each Location(L) on the active display area.

Once Time Interval(t) reaches TT, the Pixel Delta (PΔ) for the first Location(L=1) is calculated and compared to the PT. If PΔ is not less than or equal to PT, the system moves on to calculate PΔ for the next Location(L=2) and again compares PΔ to PT. When any PΔ is less than or equal to PT, an Image Retention Prevention Method is performed. Once each Position(P) has been analyzed, the system preferably returns to re-set the Time Interval(t) equal to 1 (or zero) and resumes calculating checksum data for each Location(L).

Figure 5A:
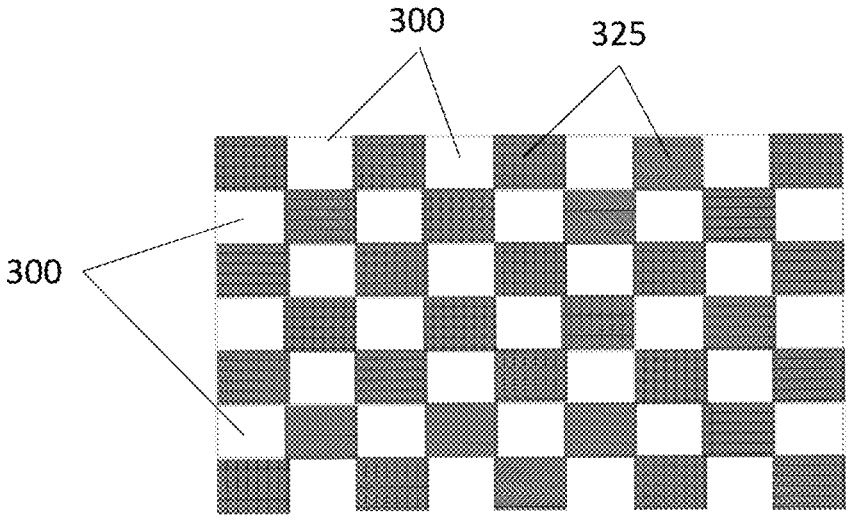
FIGS. 5A and 5B are front elevation views of a selection of pixels, where an embodiment of the Image Retention Prevention Method is being performed.
Figure 5B:
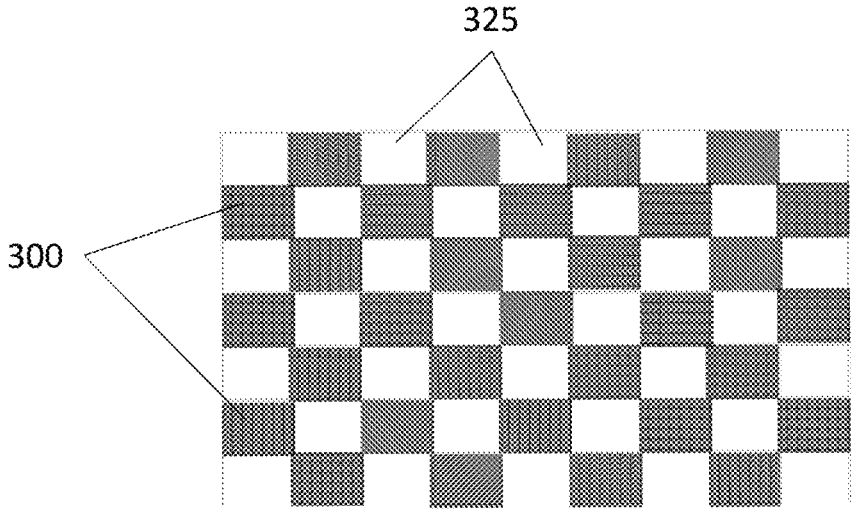

FIGS. 5A and 5B are front elevation views of a selection of pixels, where an embodiment of the Image Retention Prevention Method is being performed. Referring to FIG. 5A, odd numbered pixels are the modified pixels 325 while even numbered pixels are normal operation pixels 300. This pattern preferably continues across the entire AA (or the entire active image area of the display, as taught below) which has been determined to require the Image Retention Prevention Method. Referring to FIG. 5B, the previous pattern is preferably then switched so that even numbered pixels are the modified pixels 325 while odd numbered pixels are normal operation pixels 300.

An exemplary embodiment of the Image Retention Prevention Method would essentially transmit alternate pixel data (i.e. not the data which is necessary to create the image/video) to the modified pixels 325. While the modified pixels 325 are shown in FIGS. 5A-5B as 50% of the pixels in a selected area, this is not required. Alternatively, any selection of the pixels in the AA would be fine (ex. $\frac{1}{3}^{rd}$ of the pixels could be modified pixels 325 at any one time). In a first embodiment, the modified pixels 325 may be set to full on while the normal operation pixels 300 remain under normal operation. In a second embodiment, the modified pixels may be set to full off while the normal operation pixels 300 remain under normal operation. In a third embodiment, the modified pixels 325 may be set to full on while the normal operation pixels 300 are no longer performing a normal operation (i.e. whatever is required for the image/video) but are now set to full off. In a fourth embodiment, the modified pixels 325 may be set to full off while the normal operation pixels 300 are set to full on. In a fifth embodiment, both the modified 325 and normal operation pixels 300 are provided with the data to create the required image/video but the voltages/power for the modified pixels 325 is reduced by some factor (ex. by half, by a third, or by a small percentage) while the remaining normal operation pixels 300 continue to receive the required voltage/power to generate the image/video. In each of the embodiments, the even/odd pixels of the display preferably cycle back and forth as indicated in FIGS. 5A and 5B. When using an LED backlit LCD for the electronic display 100, it may be desirable to increase the backlight when performing the Image Retention Prevention Method, since reducing the luminance of the pixel could result in a loss of luminance of the display. In an exemplary embodiment with a direct lit dynamic dimming LED backlight, only the region of the backlight that is behind the AA being addressed would be increased in luminance, as opposed to the entire backlight. In embodiments that use other types of electronic displays, increasing the luminance of the electronic display itself (if no backlight is used) would be preferred while performing the Image Retention Prevention Method.

Figure 6:
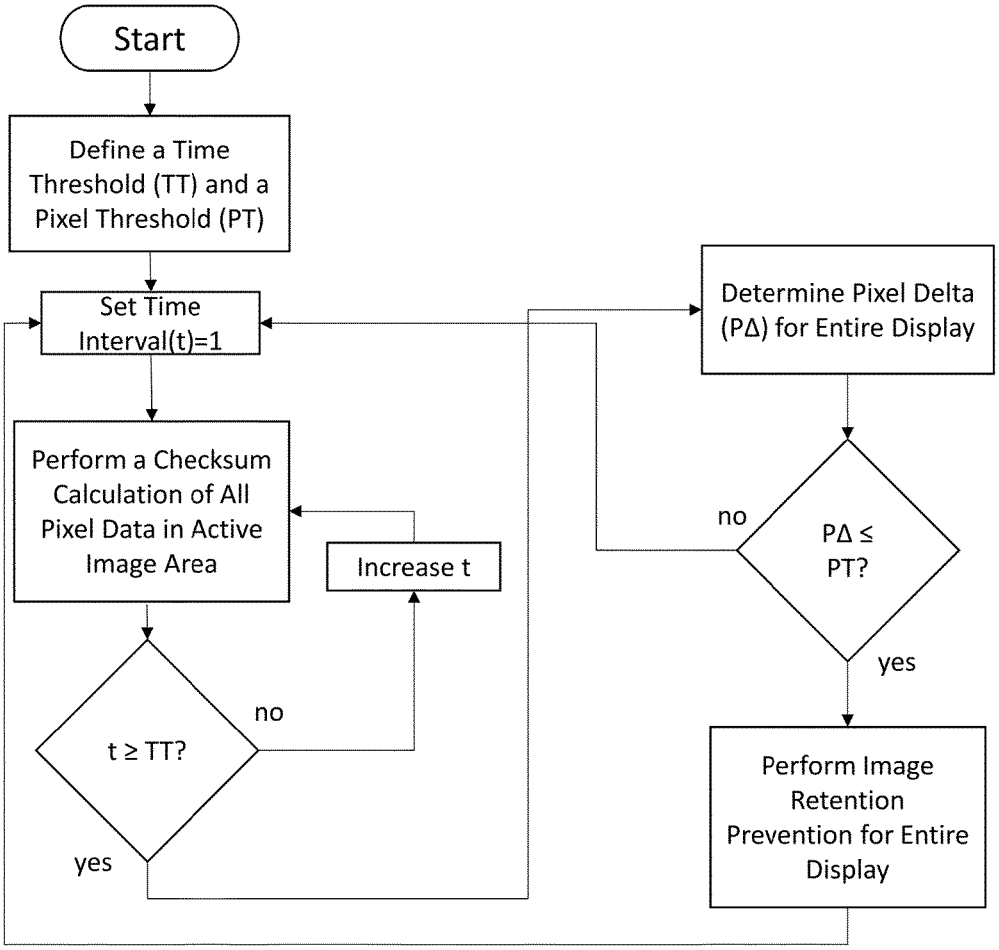
FIG. 6 is a logical flow chart for a simplified embodiment where the entire active image display area is used as the Analysis Area.

FIG. 6 is a logical flow chart for a simplified embodiment where the entire active image display area is used as the AA. This method may be appropriate for determining whether an entire display has frozen or malfunctioned so that a static image remains on the entire display for an extended period of time. Here, a checksum is performed for the pixel data across all of the pixels on the electronic display, rather than only within a designated AA that is moved across the entire display. Once checksums have been calculated for the entire Time Interval(t), PΔ is calculated for the entire display and compared to a PT for the entire display. If very little change in the pixel data is calculated, then image retention may be a concern, and the Image Retention Prevention Method should be ran for the entire display. The concept would be similar to that described above, except rather than performing the method over one or more AAs having an unacceptable PΔ, the method is ran across the entire display.

As noted above, in the exemplary embodiments the overall appearance of the display should not be affected when the Image Retention Prevention Method is performed. In other words, to a viewer, there should be no discernable difference in the viewed image whether the Image Retention Prevention Method is being ran or not.

Having shown and described a preferred embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

We claim:

1. A method for preventing image retention in an electronic display having a display controller, and a processor within the display controller, the method comprising the steps of:

defining an analysis area (AA), a time threshold (TT), and a pixel threshold (PT), and providing the AA, TT and PT to the electronic display processor;

using the electronic display processor to produce an image on an active display area of the electronic display by transmitting image pixel data to the electronic display;

moving the AA, under the command of the electronic display processor, through every location of the active display area of the electronic display;

using the electronic display processor to perform a checksum calculation of the pixel data within each location for an interval of time until reaching TT;

using the electronic display processor to compare the checksum calculation for each location across each interval of time to determine if the change in pixel data is less than PT for each location; and performing an image retention prevention procedure by causing the display controller to modify the output of some portion of the pixels residing at any location where the change in pixel data is determined to be less than PT by transmitting data other than image data to said portion of the pixels, and cycling the pixels by subsequently retransmitting image data to the output-modified portion of the pixels and transmitting data other than image data to the remaining portion of the pixels.

2. The method of claim 1 wherein:

modifying the pixel output further includes a procedure selected from the group consisting of setting the pixels with a modified output to full on while maintaining normal operation of the remaining pixels; setting the pixels with a modified output to full off while maintaining normal operation of the remaining pixels; setting the pixels with a modified output to full on while setting the remaining pixels to full off; setting the pixels with a modified output to full off while setting the remaining pixels to full on; and reducing the voltage of the pixels with a modified output while maintaining the voltage of the remaining pixels.

3. The method of claim 1 wherein:

the analysis area is less than 5% of the active display area.

4. The method of claim 1 wherein:

the step of comparing the checksum calculation for each location across each time interval comprises calculating the standard deviation for each location across each time interval.

5. The method of claim 1 wherein:

PT is between zero and one.

6. The method of claim 1 wherein:

the step of performing the checksum calculation is a summation of the bits of data sent to each pixel within the AA at each Location.

7. The method of claim 1 wherein:

PT is the minimum level of standard deviation that is acceptable before image retention becomes a concern.

8. A method for preventing image retention in an electronic display having a display controller, and a processor within the display controller, the method comprising the steps of:

defining a time threshold (TT) and a pixel threshold (PT), and providing the TT and PT to the electronic display processor;

using the electronic display processor to produce an image on an active display area of the electronic display by transmitting image pixel data to the electronic display;

using the electronic display processor to perform a checksum calculation of all pixel data within an active image area of the electronic display for an interval of time until reaching TT;

using the electronic display processor to compare the checksum calculation for each interval of time to determine if the change in pixel data is less than PT; and performing an image retention prevention procedure by causing the display controller to modify the output of some portion of the pixels residing in the active image area when the change in pixel data is determined to be less than PT by transmitting data other than image data to said portion of the pixels, and cycling the pixels by subsequently retransmitting image data to the output-modified portion of the pixels and transmitting data other than image data to the remaining portion of the pixels.

9. The method of claim 8 wherein:

the step of comparing the checksum calculation for each interval of time comprises a procedure selected from the group consisting of calculating the standard deviation across each time interval and summing the bits of data sent to each pixel within the active image area.

10. The method of claim 8 wherein:

PT is less than one.

11. The method of claim 8 wherein:

modifying the pixel output of further includes a procedure selected from the group consisting of setting the pixels with a modified output to full on while maintaining normal operation of the remaining pixels; setting the pixels with a modified output to full off while maintaining normal operation of the remaining pixels; setting the pixels with a modified output to full on while setting the remaining pixels to full off; setting the pixels with a modified output to full off while setting the remaining pixels to full on; and reducing the voltage of the pixels with a modified output while maintaining the voltage of the remaining pixels.

12. The method of claim 8 wherein:

PT is the minimum level of standard deviation that is acceptable before image retention becomes a concern.

13. The method of claim 8 wherein:

cycling of the pixels is between even and odd pixels.

14. The method of claim 8 wherein:

the image prevention retention procedure is performed without producing a noticeable difference in a displayed image to a viewer of the electronic display.

15. The method of claim 8 further comprising the step of:

increasing luminance of the electronic display while performing the image retention prevention method.

16. An electronic display assembly comprising:

an electronic display;

a display controller in electrical connection with the electronic display;

a processor within the display controller that is provided with a time threshold (TT) and a pixel threshold (PT);

is configured to transmit image pixel data to the electronic display such that an image will be produced on an active image area of the electronic display;

is programmed to perform a checksum calculation of all pixel data within the active image area of the electronic display for an interval of time until reaching TT;

is programmed to compare the checksum calculation for each interval of time to determine if the change in pixel data is less than PT; and is configured to perform an image retention prevention procedure for the active image area when the change in pixel data is determined to be less than PT by transmitting data other than image data to a portion of the pixels within the active image area such that the output of said portion of pixels will be modified, and cycling the pixels by subsequently retransmitting image data to the output-modified portion of the pixels and transmitting data other than image data to the remaining portion of the pixels.

17. The electronic display assembly of claim 16 wherein: as part of the image retention prevention procedure, the processor is further configured to perform a procedure selected from the group consisting of setting the pixels with a modified output to full on while maintaining normal operation of the remaining pixels; setting the pixels with a modified output to full off while maintaining normal operation of the remaining pixels; setting the pixels with a modified output to full on while setting the remaining pixels to full off; setting the pixels with a modified output to full off while setting the remaining pixels to full on; and reducing the voltage of the pixels with a modified output while maintaining the voltage of the remaining pixels.

18. The electronic display assembly of claim 16 wherein: the processor is configured to increase the luminance of the electronic display while performing the image retention prevention method.

* * * * *